US006761292B1

(12) United States Patent
Newman

(10) Patent No.: US 6,761,292 B1
(45) Date of Patent: Jul. 13, 2004

(54) DEVICE ADAPTED FOR USE IN DONNING A SKI BOOT AND METHOD OF USING SAID DEVICE

(76) Inventor: Elyse L. Newman, 2 Marlborough St., Boston, MA (US) 02116

( * ) Notice: Subject to any disclaimer, the term of this patent is extended or adjusted under 35 U.S.C. 154(b) by 0 days.

(21) Appl. No.: 10/217,727

(22) Filed: Aug. 13, 2002

(51) Int. Cl.[7] ..... A47G 25/80
(52) U.S. Cl. ..... 223/111; 223/118
(58) Field of Search ..... 223/118, 113, 223/111, 119; 29/226, 224; 7/124; 294/3; 43/53.5; D8/52; 36/138

(56) References Cited

U.S. PATENT DOCUMENTS

| | | | | | |
|---|---|---|---|---|---|
| 19,284 | A | | 2/1858 | Allender | |
| 28,927 | A | | 6/1860 | Wheeler | |
| 33,456 | A | | 10/1861 | Worden | |
| 57,431 | A | * | 8/1866 | Yerkes | 294/3 |
| 160,006 | A | * | 2/1875 | Conklin | 294/10 |
| 416,775 | A | | 12/1889 | Cash | |
| 867,296 | A | * | 10/1907 | Park | 119/806 |
| 974,500 | A | * | 11/1910 | Leefson | 43/53.5 |
| 1,017,093 | A | * | 2/1912 | Gilmer | 81/302 |
| 1,125,983 | A | * | 1/1915 | Dulin | 294/3 |
| 1,936,981 | A | * | 11/1933 | Houghton | 81/8.1 |
| 2,995,560 | A | * | 8/1961 | Flagstad | 546/196 |
| 3,591,226 | A | | 7/1971 | Elmore, Jr. et al. | |
| 4,615,127 | A | | 10/1986 | Delery | |
| 4,620,386 | A | * | 11/1986 | Hare | 43/4 |
| 4,667,861 | A | | 5/1987 | Harrington et al. | |
| 4,718,135 | A | | 1/1988 | Colvin | |
| 4,993,862 | A | | 2/1991 | Pelta | |
| D352,644 | S | * | 11/1994 | Fields | D8/52 |
| 5,373,596 | A | * | 12/1994 | Harrell | 12/115.4 |
| 5,392,800 | A | | 2/1995 | Sergi | |
| 5,601,322 | A | * | 2/1997 | Forest | 294/3 |
| 5,653,488 | A | * | 8/1997 | Ordonez | 294/3 |
| 5,741,569 | A | | 4/1998 | Votino et al. | |
| 5,806,729 | A | | 9/1998 | Ramon | |
| 5,875,504 | A | | 3/1999 | Tambling | |
| 5,927,573 | A | | 7/1999 | Votino et al. | |
| 5,944,736 | A | | 8/1999 | Taylor et al. | |
| 5,974,701 | A | | 11/1999 | Busch | |
| 6,065,654 | A | | 5/2000 | Evensen | |
| 6,318,607 | B1 | | 11/2001 | Koskela | |

* cited by examiner

*Primary Examiner*—John J. Calvert
*Assistant Examiner*—James G. Smith
(74) *Attorney, Agent, or Firm*—Kriegsman & Kriegsman

(57) ABSTRACT

A device suitable for use in donning a ski boot and a method of using the device to don a ski boot. According to a preferred embodiment, the device comprises a wheel mounting bracket, the wheel mounting bracket comprising a proximal end, a distal end and a longitudinally-extending slot disposed therebetween. A wheel is rotatably mounted within the longitudinally-extending slot and is shaped to include a proximal extension and a distal extension. A first handle is fixed to the distal end of the wheel mounting bracket, and a second handle is fixed to the distal extension of the wheel. A first spreader is fixed to the proximal extension of the wheel, and a second spreader is fixed to the proximal end of the wheel mounting bracket. The wheel is provided with a plurality of teeth along its periphery. A pawl, which is pivotally mounted on the wheel mounting bracket, is engageable with the teeth and is biased towards the teeth by a spring clip.

17 Claims, 5 Drawing Sheets

DEVICE ADAPTED FOR USE IN DONNING A SKI BOOT AND METHOD OF USING SAID DEVICE

BACKGROUND OF THE INVENTION

The present invention relates generally to devices adapted for use in donning footwear and more particularly to a novel device adapted for use in donning a ski boot and to a method of using said device.

The difficulties associated with donning tight-fitting articles of footwear of the type having a closed-heel are well-chronicled and are attributable in large part to the fact that while, in many instances, it is desirable to make such footwear as rigid as possible to provide protection to a foot disposed therein, such rigidity makes the insertion of a foot into the article of footwear more difficult. One common approach to this problem has been the use of a conventional shoe horn. Examples of other types of devices that are designed for use in donning footwear are disclosed in the following U.S. patents, all of which are incorporated herein by reference: U.S. Pat. No. 6,318,607, inventor Koskela, which issued Nov. 20, 2001; U.S. Pat. No. 6,065,654, inventor Evensen, which issued May 23, 2000; U.S. Pat. No. 5,974,701, inventor Busch, which issued Nov. 2, 1999; U.S. Pat. No. 5,927,573, inventors Votino et al., which issued Jul. 27, 1999; U.S. Pat. No. 5,806,729, inventor Ramon, which issued Sep. 15, 1998; U.S. Pat. No. 5,741,569, inventors Votino et al., which issued Apr. 21, 1998; U.S. Pat. No. 5,392,800, inventor Sergi, which issued Feb. 28, 1995; U.S. Pat. No. 4,718,135, inventor Colvin, which issued Jan. 12, 1988; U.S. Pat. No. 4,667,861, inventors Harrington et al., which issued May 26, 1987; U.S. Pat. No. 3,591,226, inventors Elmore et al., which issued Jul. 6, 1971; and U.S. Pat. No. 28,927, inventor Wheeler, which issued Jun. 28, 1860.

As can readily be appreciated, the aforementioned difficulties associated with the donning of tight-fitting footwear are especially acute in the case of ski boots, which must be particularly rigid and tight-fitting to afford optimal protection and support to the ski boot wearer. Unfortunately, however, because of the size, shape and rigidity of most ski boots, most shoe horns and other devices of the type discussed above are of little use in helping one to don a ski boot. As a result, the typical way in which a skier dons a ski boot is to insert her foot into the boot while, at the same time, manually spreading apart the cuff portions of the boot disposed on opposite sides of the boot tongue. However, as can readily be appreciated, this task is often too onerous for many children and other weaker individuals. Consequently, it is often necessary for such individuals to enlist the aid of a second person to spread apart the opposing cuff portions of the boot while the skier inserts her foot into the boot. As can be imagined, where there are many individuals in need of assistance and a limited number of people available for help, the foregoing procedure can become quite time-consuming and can even cause a delay to those individuals who are helping others from donning their own ski boots. Moreover, it can readily be appreciated that the task of spreading apart the opposing cuff portions can be tiring, both to those working on their own ski boots and to those working on the ski boots of others.

SUMMARY OF THE INVENTION

It is an object of the present invention to provide a novel device adapted for use in donning a ski boot.

It is another object of the present invention to provide a device as described above that overcomes at least some of the problems discussed above in connection with the donning of ski boots.

It is still another object of the present invention to provide a device as described above that is adapted to be used either by the skier wishing to don her own ski boot or by a first individual wishing to help a second individual to don a ski boot.

It is still yet another object of the present invention to provide a device as described above that has a minimal number of parts, that can be mass-produced and that is easy to operate.

According to the above and other objects to be described or apparent from the description which follows, there is provided herein a device suitable for use in donning a ski boot, said device comprising (a) a first handle; (b) a second handle; (c) a first spreader; (d) a second spreader; and (e) means for coupling said first and second handles to said first and second spreaders so that said first and second spreaders may be pivoted away from one another by pivoting said first and second handles away from one another.

In a preferred embodiment, the device comprises a wheel mounting bracket, the wheel mounting bracket comprising a proximal end, a distal end and a longitudinally-extending slot disposed therebetween. A wheel is rotatably mounted within the longitudinally-extending slot and is shaped to include a proximal extension and a distal extension. A first handle is fixed to the distal end of the wheel mounting bracket, and a second handle is fixed to the distal extension of the wheel. The first and second handles are mirror images of one another viewed along their respective longitudinal axes, each of the first and second handles being a unitary structure. The first handle is shaped to include a generally rectangular intermediate portion, a generally rectangular proximal end, a trapezoidal intermediate portion, and a distal end. The proximal end of the first handle is of reduced width as compared to the generally rectangular intermediate portion. The trapezoidal intermediate portion is disposed between the generally rectangular intermediate portion and the proximal end, said trapezoidal intermediate portion tapering in width from said generally rectangular intermediate portion to said proximal end. The distal end is of intermediate width as compared to the generally rectangular intermediate portion and the proximal end. The sides of the distal end are turned upwardly, the remainder of said first handle being coplanar.

A first spreader is fixed to the proximal extension of the wheel, and a second spreader is fixed to the proximal end of the wheel mounting bracket. The first and second spreaders are mirror images of one another viewed along their respective longitudinal axes, each of the first and second spreaders being a unitary structure. The first spreader is shaped to include generally rectangular first intermediate portion. An upwardly extending, generally rectangular second intermediate portion extends distally from said generally rectangular first intermediate portion. A generally rectangular third intermediate portion extends distally from said upwardly extending, generally rectangular second intermediate portion, said generally rectangular third intermediate portion extending generally parallel to said generally rectangular first intermediate portion. The first spreader also includes a generally rectangular distal end of reduced width as compared to said generally rectangular third intermediate portion, a trapezoidal fourth intermediate portion disposed between said generally rectangular third intermediate portion and said proximal end, said trapezoidal fourth intermediate portion tapering in width from said generally rectangular third intermediate portion to said distal end. The first spreader further includes a proximal end extending proximally from said generally rectangular first intermediate portion and curving upwardly away therefrom.

The wheel is provided with a plurality of teeth along its periphery. A pawl, which is pivotally mounted on the wheel mounting bracket, is engageable with the teeth and is biased towards the teeth by a spring clip so that the pawl engages the teeth in a ratchet-type manner as the handles are pivoted away from one another. To pivot the handles back towards one another (once the device has been successfully used), one pivots the pawl away from the wheel, thereby releasing the pawl from engagement with the teeth.

It is a further object of the present invention to provide a method of using said device to facilitate donning a ski boot or to facilitate removal of a ski boot from a wearer.

For purposes of the present specification and claims, it is to be understood that certain terms used herein, such as "on," "over," and "in front of," when used to denote the relative positions of two or more components of the device, are used to denote such relative positions in a particular orientation and that, in a different orientation, the relationship of said components may be reversed or otherwise altered.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF PREFERRED EMBODIMENTS

Figure 1:
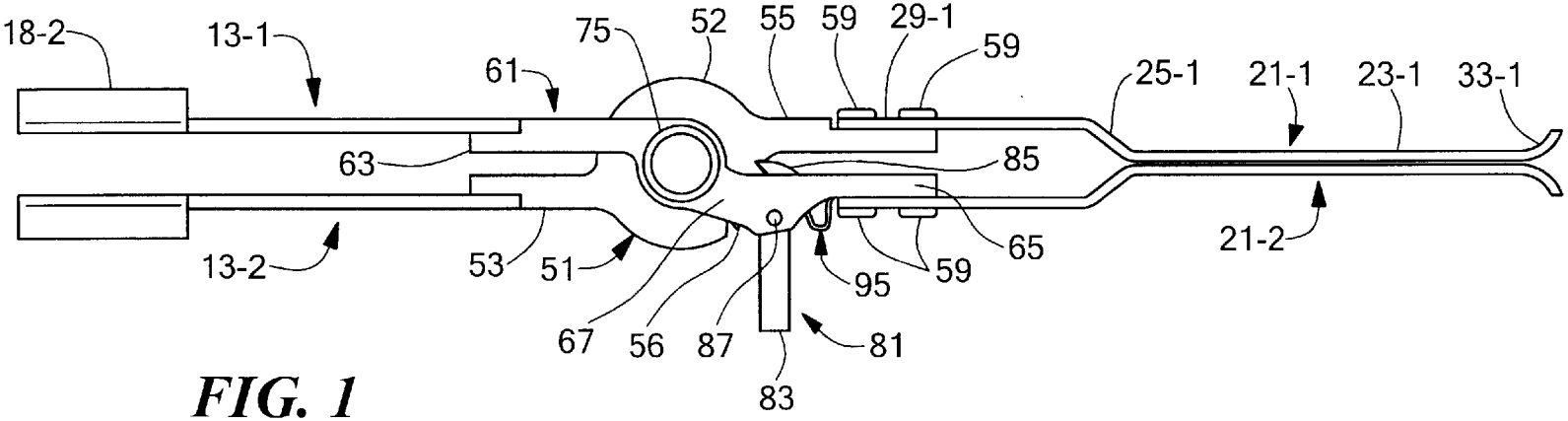
FIG. 1 is a side view of one embodiment of a device adapted for use in donning a ski boot, said device being constructed according to the teachings of the present invention.
Figure 2:
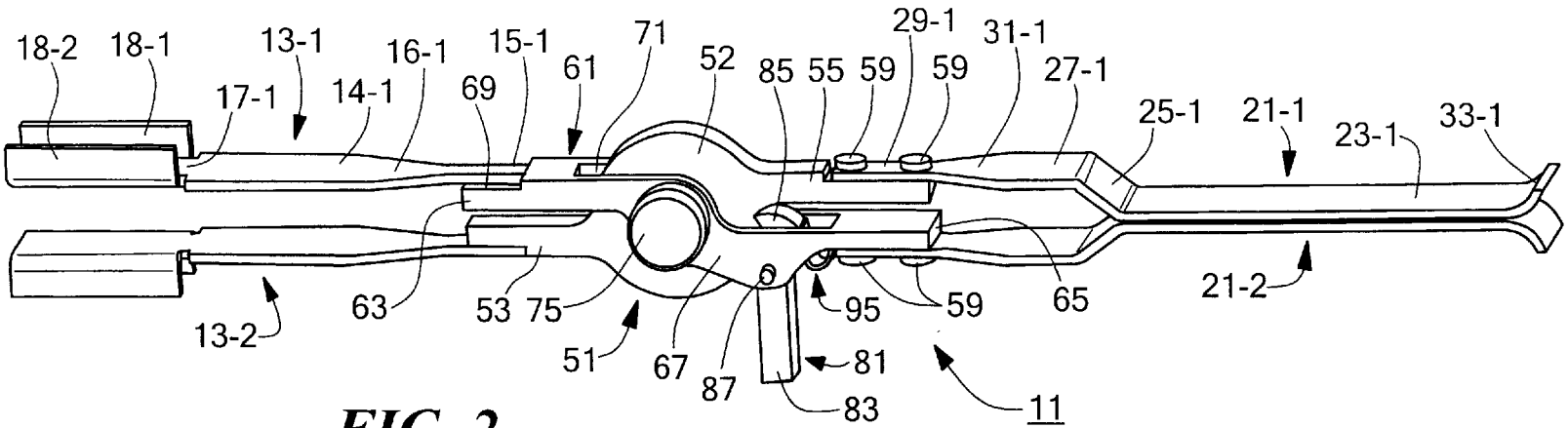
FIG. 2 is a perspective view of the device of FIG. 1.
Figure 3:
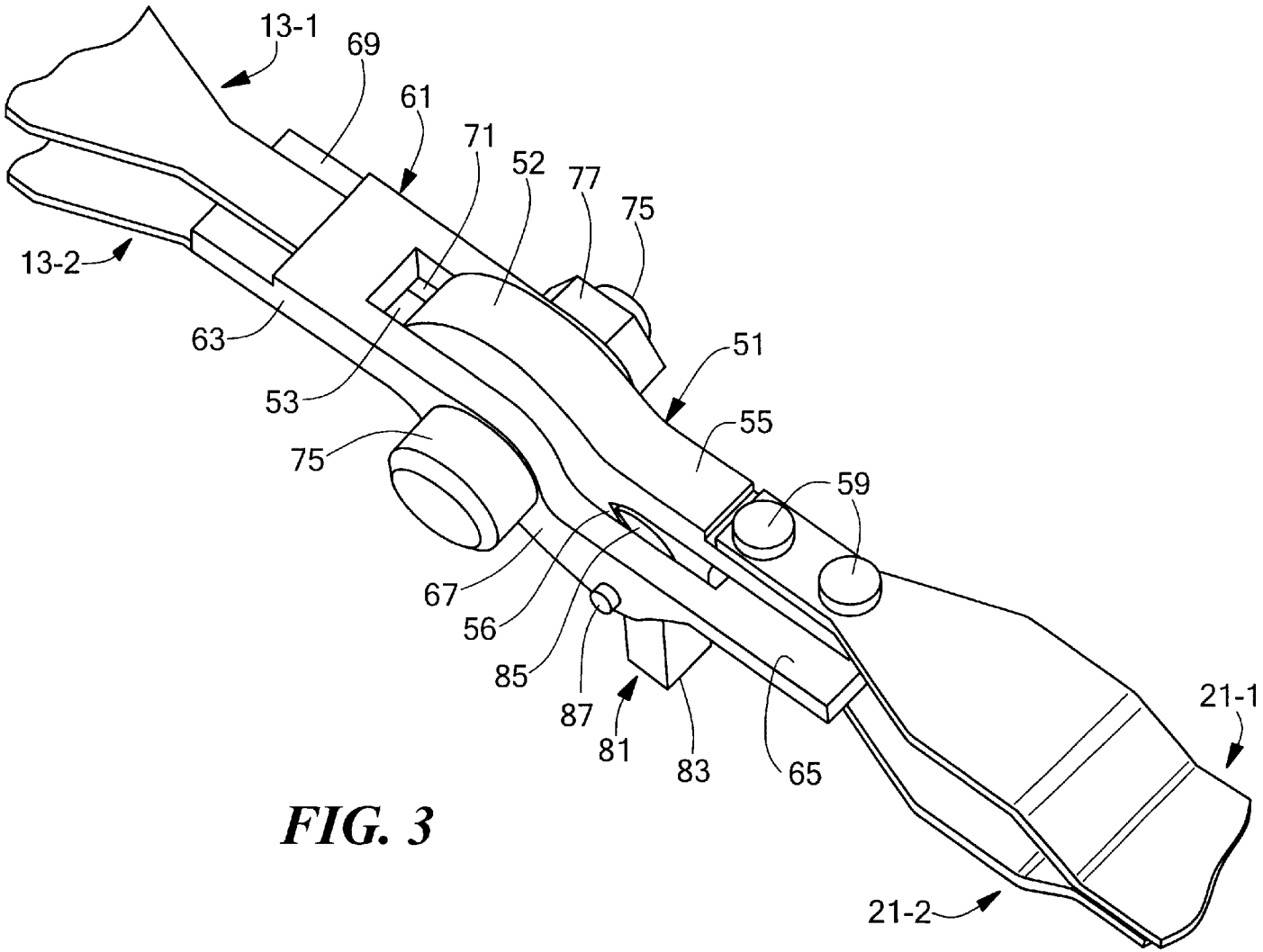
FIG. 3 is an enlarged fragmentary perspective view of the device of FIG. 1.
Figure 4:
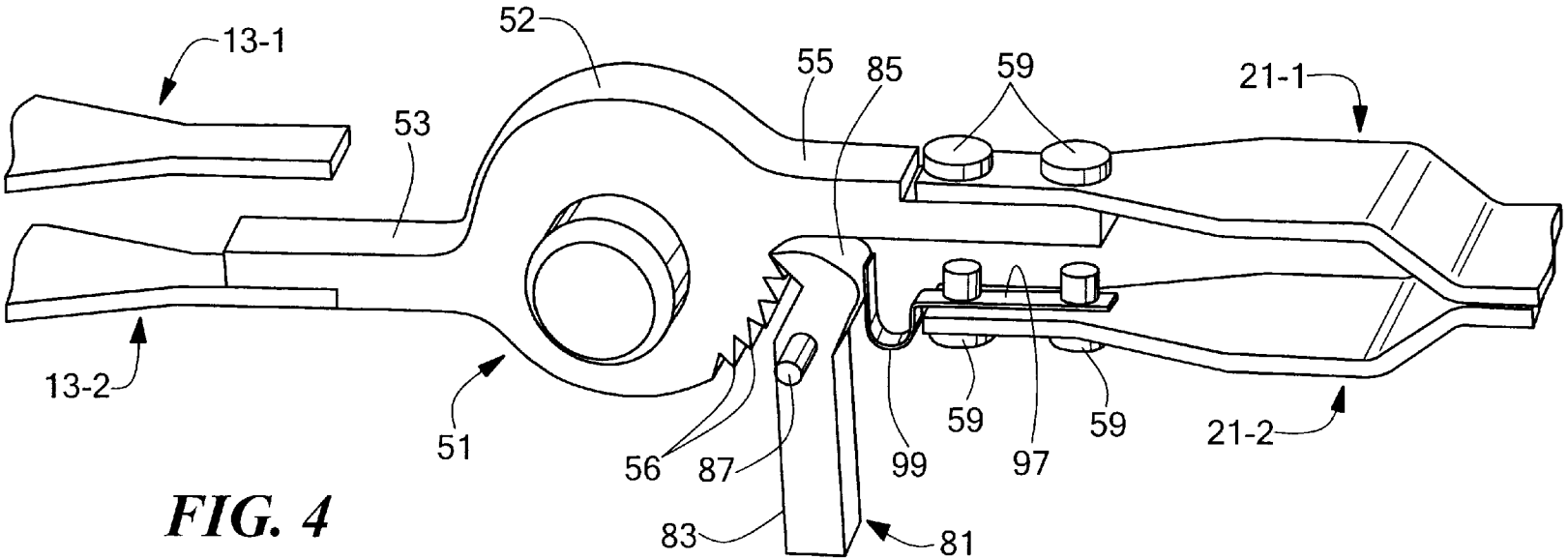
FIG. 4 is an enlarged fragmentary perspective view of the device of FIG. 1, the bracket member thereof not being shown to reveal components otherwise obscured thereby.

Referring now to FIGS. 1 through 4, there are shown various views of one embodiment of a device adapted for use in donning a ski boot, said device being constructed according to the teachings of the present invention and being represented generally by reference numeral 11.

Figure 5:
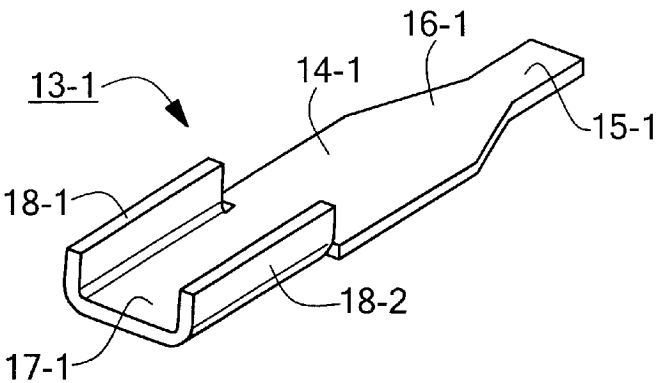
FIG. 5 is an enlarged perspective view of the handle shown in FIG. 1.

Device 11 comprises a pair of identical handles 13-1 and 13-2, handles 13-1 and 13-2 facing away from one another in a mirror image orientation for reasons to become apparent below. Referring now to FIG. 5, handle 13-1 is shown by itself; it being understood that the description of handle 13-1 to follow applies to handle 13-2 as well, albeit in a mirror image orientation. Handle 13-1 is an elongated unitary structure, preferably made of a durable metal or a durable molded plastic. Handle 13-1 is shaped to include a flat, generally rectangular intermediate portion 14-1, a flat, generally rectangular proximal end 15-1, a flat, trapezoidal intermediate portion 16-1, and a distal end 17-1. Proximal end 15-1 is of reduced width as compared to intermediate portion 14-1. Portion 16-1 is disposed between intermediate portion 14-1 and proximal end 15-1 and tapers in width from intermediate portion 14-1 to proximal end 15-1. Distal end 17-1 is of intermediate width as compared to intermediate portion 14-1 and proximal end 15-1. The sides 18-1 and 18-2 of distal end 17-1 are turned upwardly (or, in the case of handle 13-2, downwardly) to facilitate the grasping of distal end 17-1 by a user, the remainder of handle 13-1 being coplanar.

Figure 6:
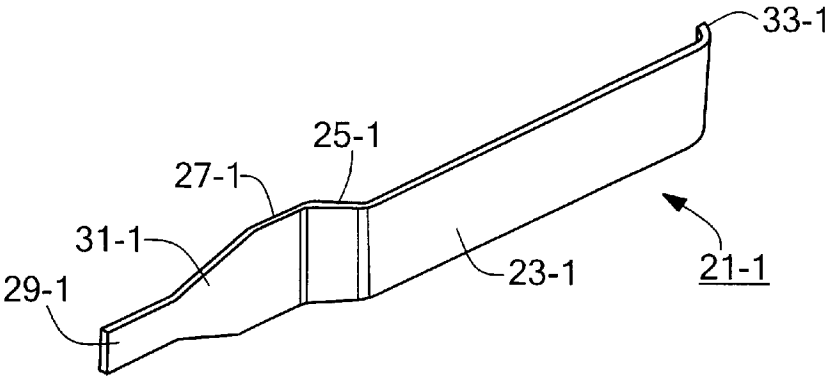
FIG. 6 is an enlarged perspective view of the spreader shown in FIG. 1.

Referring back now to FIGS. 1 through 4, device 11 further comprises a pair of identical spreaders 21-1 and 21-2, spreaders 21-1 and 21-2 facing away from one another in a mirror image orientation for reasons to become apparent below. Referring now to FIG. 6, spreader 21-1 is shown by itself, it being understood that the description of spreader 21-1 to follow applies to spreader 21-2 as well, albeit in a mirror image orientation. Spreader 21-1 is an elongated unitary structure, preferably made of a durable metal or a durable molded plastic. Spreader 21-1 is shaped to include an elongated, flat, generally rectangular intermediate portion 23-1, an upwardly bent (or, in the case of spreader 21-2, downwardly bent), generally rectangular intermediate portion 25-1 extending distally from intermediate portion 23-1, a flat, generally rectangular intermediate portion 27-1 extending distally from intermediate portion 25-1 and generally parallel to intermediate portion 23-1, a flat, generally rectangular distal end 29-1, distal end 29-1 being of reduced width as compared to intermediate portion 27-1, a flat, trapezoidal intermediate portion 31-1, portion 31-1 being disposed between intermediate portion 27-1 and proximal end 29-1 and tapering in width from intermediate portion 27-1 to distal end 29-1, and a proximal end 33-1 extending proximally from intermediate portion 23-1 and curving upwardly (or, in the case of spreader 21-2, downwardly) away therefrom.

Figure 7:
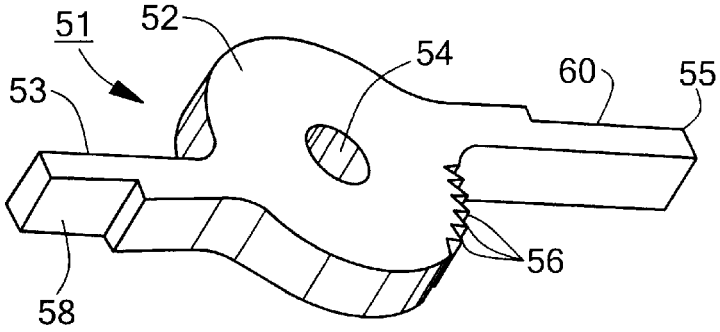
FIG. 7 is an enlarged perspective view of the wheel shown in FIG. 1.
Figure 8:
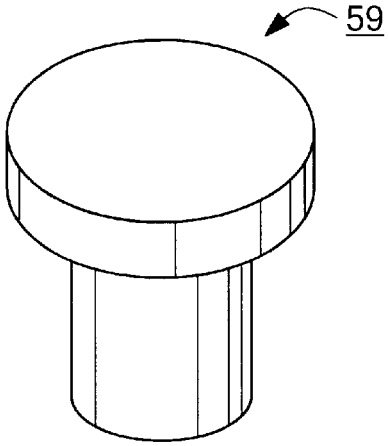
FIG. 8 is an enlarged perspective view of one of the bolts shown in FIG. 1 used to secure the top spreader to the wheel.

Referring back now to FIGS. 1 through 4, device 11 further comprises means for coupling together handles 13-1 and 13-2 and spreaders 21-1 and 21-2 so that spreaders 21-1 and 21-2 may be pivoted away from one another in a ratchet-type manner. Said coupling means comprises, in the present embodiment, a wheel 51 and a wheel mounting bracket 61. Wheel 51, which is also shown separately in FIG. 7, is a unitary structure preferably made of a durable metal or a durable molded plastic. Wheel 51 is shaped to include a central annular portion 52 and a pair of off-center lateral extensions 53 and 55, extensions 53 and 55 extending parallel to one another from opposite points around the periphery of annular portion 52. Annular portion 52 is shaped to include a central transverse opening 54, the purpose of which will be discussed below, and a plurality of teeth 56, the purpose of which will also be discussed below, teeth 56 being located below extension 55 along a segment of the periphery of portion 52. Handle 13-2 is fixedly secured (by an adhesive or other suitable means not shown) to the bottom surface of extension 53, extension 53 having a recessed area 58 so that handle 13-2 lies flush with the remainder of extension 53. Spreader 21-1 is fixedly secured by a pair of bolts 59 (one such bolt 59 being shown separately in FIG. 8) to the top surface of extension 55, extension 55 having a recessed area 60 so that spreader 21-1 lies flush with the remainder of extension 55. As can readily be appreciated, bolts 59 could be replaced with an adhesive or other suitable means.

Figure 10:
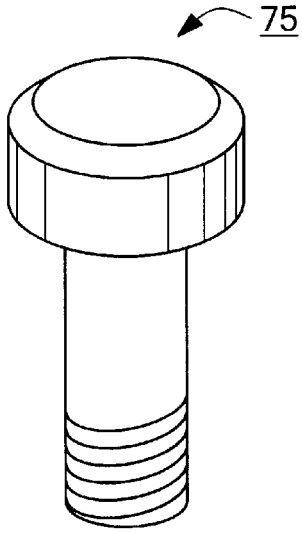
FIG. 10 is an enlarged perspective view of the shoulder screw shown in FIG. 1.
Figure 11:
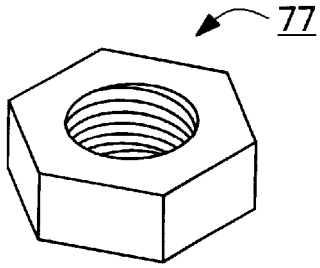
FIG. 11 is an enlarged perspective view of the nut shown in FIG. 1.
Figure 9:
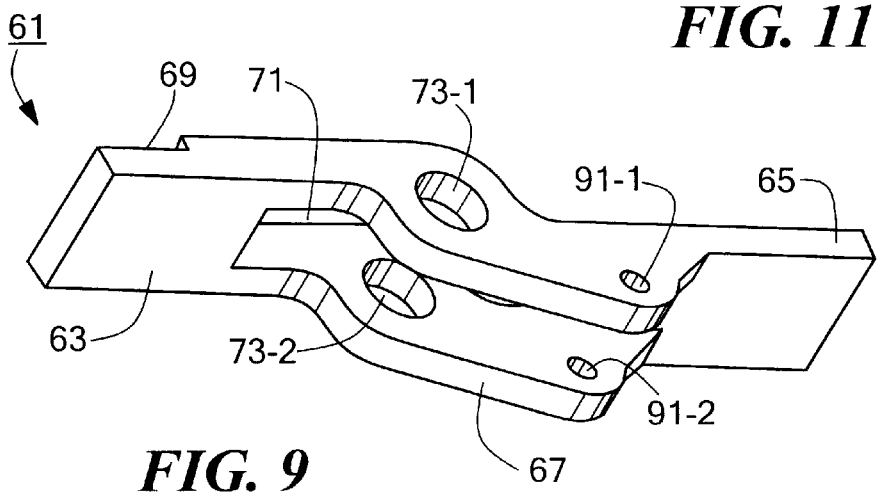
FIG. 9 is an enlarged perspective view of the wheel mounting bracket shown in FIG. 1.

Wheel mounting bracket 61 (which is shown separately in FIG. 9) is an elongated unitary structure, preferably made of a durable metal or durable molded plastic. Bracket 61 is shaped to include a distal portion 63, a proximal portion 65 and an intermediate portion 67, intermediate portion 67 interconnecting distal portion 63 and proximal portion 65. Distal portion 63 and proximal portion 65 extend generally parallel to one another in different planes, with intermediate portion 67 extending downwardly from distal portion 63 to proximal portion 65. Handle 13-1 is fixed (by an adhesive or other suitable means) to the top surface of distal portion 63, distal portion 63 having a recessed area 69 on its top surface so that handle 13-1 lies flush with the remainder of distal portion 63. Spreader 21-2 is fixedly secured by a pair of bolts 59 to the bottom surface of proximal portion 65. As can readily be appreciated, bolts 59 could be replaced with an adhesive or other suitable means. A longitudinal slot 71, which extends from distal portion 63 to proximal portion 65, is provided in bracket 61, wheel 51 being received in slot 71. A first pair of transverse openings 73-1 and 73-2 are formed in bracket 61, openings 73-1 and 73-2 communicating with slot 71 and being aligned with opening 54 of wheel 51. A shoulder screw 75 (shown separately in FIG. 10) is inserted through opening 73-1, opening 54 and opening 73-2, respectively, and is secured in place with a nut 77 (shown separately in FIG. 11), screw 75 serving as an axle about which wheel 51 is permitted to rotate.

Figure 12:
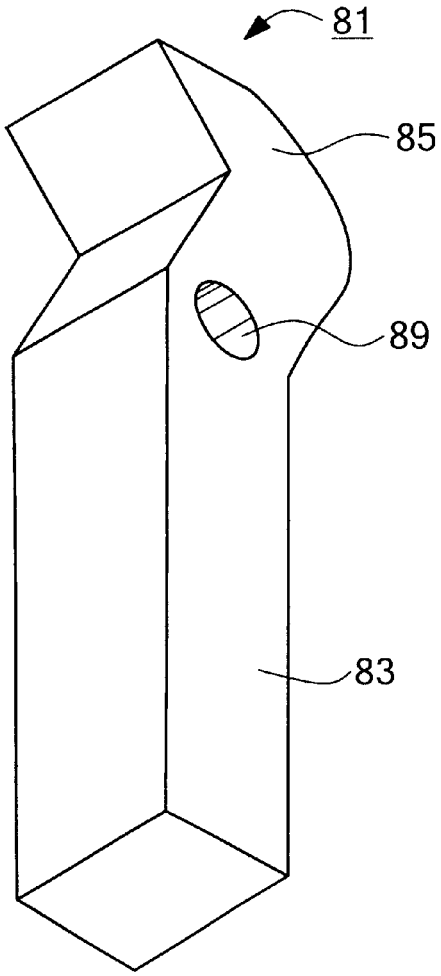
FIG. 12 is an enlarged perspective view of the pawl shown in FIG. 1.
Figure 13:
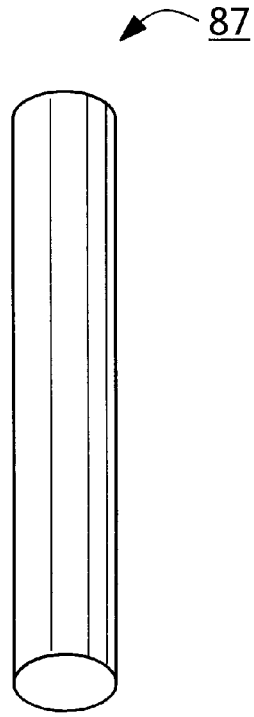
FIG. 13 is an enlarged perspective view of the pin shown in FIG. 1.
Figure 14:
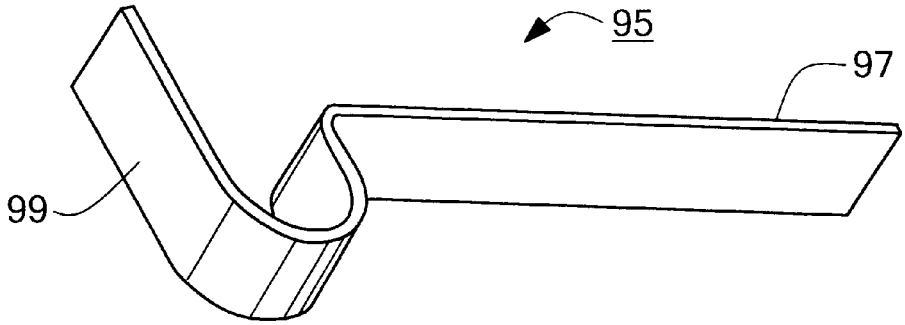
FIG. 14 is an enlarged perspective view of the clip shown in FIG. 1.

Said coupling means further comprises a pawl 81 (which is shown separately in FIG. 12). Pawl 81, which is an elongated unitary structure, preferably made of a durable metal or durable molded plastic, is shaped to include a generally rectangular lower portion 83 and a hook-shaped upper portion 85. Pawl 81 extends transversely through longitudinal slot 71 of bracket 61 and is pivotally mounted on a pin 87 (which is shown separately in FIG. 13) so that upper portion 85 of pawl 81 is adapted to engage teeth 56 of annular portion 52. The aforementioned pivotal mounting of pawl 81 on pin 87 is achieved by insertion of pin 87 through a transverse opening 89 in pawl 81 and through a pair of transverse openings 91-1 and 91-2 provided in bracket 61.

Said coupling means further comprises resilient means for biasing upper portion 85 of pawl 81 towards teeth 56 of annular portion 52. In the present embodiment, said biasing means comprises a spring clip 95. Clip 95, which is an elongated unitary structure, preferably made of a resilient metal or resilient molded plastic, is shaped to include a proximal portion 97 and a distal portion 99. Proximal portion 97, which is generally flat and rectangular in shape, is sandwiched between the top surface of spreader 21-2 and the bottom surface of proximal portion 65 and is secured in place by bolts 59. Distal portion 99 is hook-shaped and is adapted to engage upper portion 85 of pawl 81 in such a manner as to bias upper portion 85 distally towards teeth 56 of annular portion 52 for a ratchet-type action.

To use device 11 for the donning of a ski boot, one first rotates device 11 about 90 degrees about its longitudinal axis so that spreaders 21-1 and 21-2 are positioned side-by-side, as opposed to stacked (as shown in FIGS. 1 through 4). One then grasps handles 13-1 and 13-2 with one's hands and inserts spreaders 21-1 and 21-2 between the opposing cuff portions of the ski boot to be donned. Next, one pivots handles 13-1 and 13-2 away from one another until spreaders 21-1 and 21-2 have correspondingly been pivoted away from one another and have opened the ski boot sufficiently for the wearer's foot to be inserted thereinto. Because of the ratchet-type action of device 11, even if one ceases to apply a pivoting force to handles 13-1 and 13-2, spreaders 21-1 and 21-2 do not revert to their original orientation until desired. Once the ski boot has been donned and it is desirable to pivot spreaders 21-1 and 21-2 back towards one another, one simply pivots lower portion 83 of pawl 81 towards annular portion 52, thereby releasing upper portion 85 of pawl 81 from teeth 56, and pivots handles 13-1 and 13-2 back towards one another.

As can readily be appreciated, device 11 can be used both by a person wishing to don her own ski boot(s) or by a person wishing to help another person to don one or more ski boots. In addition, it should also be appreciated that device 11, in addition to being used to don a ski boot, can also be used to open a ski boot to permit its removal from a wearer. Lastly, it should further be appreciated that device 11 is not limited to use in the donning or removal of ski boots and can be used to don or to remove other types of footwear.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A device suitable for use in donning a ski boot, said device comprising:

a) a first handle;

b) a second handle;

c) a first spreader;

d) a second spreader; and e) means for coupling said first and second handles to said first and second spreaders so that said first and second spreaders may be pivoted away from one another by pivoting said first and second handles away from one another wherein said coupling means comprises a wheel and a wheel mounting bracket, said wheel mounting, bracket having a longitudinally-extending slot, said wheel being rotatable mounted in said longitudinally-extending slot.

2. The device as claimed in claim 1 wherein said first and second handles are mirror images of one another along their respective lengths.

3. The device as claimed in claim 2 wherein said first handle is a unitary structure shaped to include a generally rectangular intermediate portion, a generally rectangular proximal end of reduced width compared to said generally rectangular intermediate portion a generally trapezoidal intermediate portion extending between said generally rectangular intermediate portion and said generally rectangular proximal end, and a distal end.

4. The device as claimed in claim 3 wherein said distal end is of intermediate width as compared to said generally rectangular intermediate portion and said generally rectangular proximal end, the sides of said distal end being turned upwardly.

5. The device as claimed in claim 1 wherein said first and second spreaders are mirror images of one another along their respective lengths.

6. The device as claimed in claim 5 wherein said first spreader is a unitary structure shaped to include a generally rectangular first intermediate portion, an upwardly extending, generally rectangular second intermediate portion extending distally from said generally rectangular first intermediate portion, a generally rectangular third intermediate portion extending distally from said upwardly extending, generally rectangular second intermediate portion and generally parallel to said generally rectangular first intermediate portion, a generally rectangular distal end of reduced width as compared to said generally rectangular third intermediate portion, a trapezoidal fourth intermediate portion disposed between said generally rectangular third intermediate portion and said proximal end and tapering in width from said generally rectangular third intermediate portion to said distal end, and a proximal end extending proximally from said generally rectangular first intermediate portion and curving upwardly away therefrom.

7. The device as claimed in claim 1 wherein said first handle and said second spreader are fixed to said wheel and wherein said second handle and said first spreader are fixed to said wheel mounting bracket.

8. The device as claimed in claim 7 further comprising releasable ratchet means for maintaining said wheel at a desired angular position relative to said wheel mounting bracket.

9. A device suitable for use in donning a ski boot, said device comprising:

a) a wheel mounting bracket, said wheel mounting bracket comprising a proximal end, a distal end and a longitudinally-extending slot disposed therebetween;

b) a wheel, said wheel being rotatably mounted within said longitudinally-extending slot and being shaped to include a proximal extension and a distal extension;

c) a first handle, said first handle being fixed to said distal end of said wheel mounting bracket;

d) a second handle, said second handle being fixed to said distal extension of said wheel;

e) a first spreader, said first spreader being fixed to said proximal extension of said wheel; and f) a second spreader, said second spreader being fixed to said proximal end of said wheel mounting bracket.

10. The device as claimed in claim 9 wherein said wheel is provided with a plurality of peripherally-disposed teeth, said device further comprising a pawl, said pawl being releasably engageable with said peripherally-disposed teeth to permit said wheel to be releasably locked in a desired angular orientation relative to said wheel mounting bracket.

11. The device as claimed in claim 9 wherein said wheel is provided with a plurality of peripherally-disposed teeth, said device further comprising means for releasably engaging said peripherally-disposed teeth to permit said wheel to be releasably locked in a desired angular orientation relative to said wheel mounting bracket.

12. The device as claimed in claim 11 wherein said releasably engaging means comprises a pawl pivotally mounted on said wheel mounting bracket, said pawl having an upper portion adapted to engage said peripherally-disposed teeth, and a spring, said spring biasing said upper portion of said pawl towards said peripherally-disposed teeth.

13. A method of donning a ski boot, said method comprising the steps of:

(a) providing a ski boot, said ski boot having a pair of opposing cuff portions;

(b) providing a device comprising:

(i) a first handle;

(ii) a second handle;

(iii) a first spreader;

(iv) a second spreader; and (v) means for coupling said first and second handles to said first and second spreaders so that said first and second spreaders may be pivoted away from one another by pivoting said first and second handles away from one another;

(c) inserting said first and second spreaders of said device between said opposing cuff portions; and (d) using said first and second handles to pivot said first and second spreaders away from one another until said first and second spreaders have moved the opposing cuff portions away from one another sufficiently to permit a skier to insert her foot into the ski boot.

14. The method as claimed as claimed in claim 13 wherein said inserting and using steps are performed by the skier whose foot is inserted into the ski boot.

15. A method of donning a ski boot, said method comprising the steps of:

(a) providing a ski boot, said ski boot having a pair of opposing cuff portions;

(b) providing a device comprising (i) a wheel mounting bracket, said wheel mounting bracket comprising a proximal end, a distal end and a longitudinally-extending slot disposed therebetween;

(ii) a wheel, said wheel being rotatable mounted within said longitudinally-extending slot and being shaped to include a proximal extension and a distal extension, said wheel being provided with a plurality of peripherally-disposed teeth;

(iii) means for releasably engaging said peripherally-disposed teeth to permit said wheel to be releasably locked in a desired angular orientation relative to said wheel mounting bracket wherein said releasably engaging means comprises a pawl pivotally mounted on said wheel mounting bracket, said pawl having an upper portion adapted to engage said peripherally-disposed teeth, and a spring, said spring biasing said upper portion of said pawl towards said peripherally-disposed teeth;

(iv) a first handle, said first handle being fixed to said distal end of said wheel mounting bracket;

(v) a second handle, said second handle being fixed to said distal extension of said wheel;

(vi) a first spreader, said first spreader being fixed to said proximal extension of said wheel; and (vii) a second spreader, said second spreader being fixed to said proximal end of said wheel mounting bracket;

(c) inserting said first and second spreaders of said device between said opposing cuff portions; and (d) using said first and second handles to pivot said first and second spreaders away from one another until said first and second spreaders have moved the opposing cuff portions away from one another sufficiently to permit a skier to insert her foot into the ski boot.

16. The method as claimed as claimed in claim 15 wherein said inserting and using steps are performed by the skier whose toot is inserted into the ski boot.

17. A method of opening a ski boot, said method comprising the steps of:

(a) providing a ski boot, said ski boot having a pair of opposing cuff portions;

(b) providing a device comprising:

(i) a first handle;

(ii) a second handle;

(iii) a first spreader;

(iv) a second spreader; and (v) means for coupling said first and second handles to said first and second spreaders so that said first and second spreaders may be pivoted away from one another by pivoting said first and second handles away from one another;

(c) inserting said first and second spreaders of said device between said opposing cuff portions; and (d) using said first and second handles to pivot said first and second spreaders away from one another until said first and second spreaders have moved the opposing cuff portions away from one another.

* * * * *